United States Patent [19]

Weiss

[11] Patent Number: 4,813,159

[45] Date of Patent: Mar. 21, 1989

[54] FOOT SUPPORT FOR OPTIMUM RECOVERY

[76] Inventor: Robert F. Weiss, 350 Barrack Hill Rd., Ridgefield, Conn. 06877

[21] Appl. No.: 49,229

[22] Filed: May 13, 1987

[51] Int. Cl.[4] ..... A43B 13/38; A43B 13/41

[52] U.S. Cl. ..... 36/43; 36/44; 128/585

[58] Field of Search ..... 36/43, 44, 71, 91; 128/584, 585, 581, 595, 600, 614, 615, 621, 622

[56] References Cited

U.S. PATENT DOCUMENTS

| | | | |
|---|---|---|---|
| 1,847,973 | 3/1932 | Morton | 128/595 |
| 1,958,097 | 5/1934 | Shaw | 36/43 |
| 2,068,786 | 1/1937 | Balaskas | 36/44 |
| 2,415,580 | 2/1947 | Davis | 128/581 |
| 2,616,190 | 11/1952 | Darby | 128/585 |
| 2,623,307 | 12/1952 | Morton | 36/71 |
| 4,170,233 | 10/1979 | Bunsick | 128/586 |
| 4,216,778 | 8/1980 | Weiss | 128/581 |
| 4,224,750 | 9/1980 | Delport | 36/91 |
| 4,240,214 | 12/1980 | Sigle et al. | 128/595 |
| 4,317,293 | 3/1982 | Sigle et al. | 36/43 |
| 4,408,402 | 10/1983 | Looney | 36/43 |
| 4,517,981 | 5/1985 | Santopietro et al. | 36/43 |
| 4,633,598 | 1/1987 | Moronaga et al. | 36/44 |
| 4,674,201 | 6/1987 | Weiss | 36/44 |
| 4,685,227 | 8/1987 | Simmons | 128/585 |

*Primary Examiner*—Steven N. Meyers
*Attorney, Agent, or Firm*—Finnegan, Henderson, Farabow, Garrett & Dunner

[57] ABSTRACT

A forward recovery foot support system for any shoe but primarily for running and jogging shoes. The system includes a base conforming generally to the contour of a human foot, a first ray extension attached to the base and extending substantially only under the first proximal phalanx of the foot, a fifth ray extension attached to the base and extending substantially only under the fifth proximal phalanx of the foot, and a heel post attached to the base and extending substantially only under the heel bone and providing added elevation at the most lateral aspect of the heel bone to compensate for the natural inversion of 2°–3° that is present in most persons' heels. This support can be designed as an insert independent of a conventional shoe sole or may be incorporated into the sole of a shoe.

32 Claims, 3 Drawing Sheets

FOOT SUPPORT FOR OPTIMUM RECOVERY

BACKGROUND OF THE INVENTION

A. Field of the Invention

The present invention relates to a support system for shoes, including walking, jogging and running shoes. The invention includes a heel post to control rearfoot pronation and transfer the running forces forward over the entire forefoot, a fifth (little) toe extension or support to compensate for lateral imbalance by establishing an effective inward rotation of the foot and preventing outward rotation, and a first (big) toe extension or support to stabilize the first metatarsal. The fifth and first extensions terminate distally underneath the neck portion of the fifth and first proximal phalanges, respectively, to improve stability and balance. The heel post terminates distally underneath the posterior end of the knee bone and provides a lift on the lateral side to correct the normal inversion of a human heel. The heel post and extensions cooperate to promote proper weight transfer and movement, provide increased stability, and decrease strains and injuries.

B. Description of the Prior Art

When a person runs or even walks, the human foot and its many bones and connecting tissues are subjected to a complex combination of movements and forces. As a person moves through a single stride, his foot contacts the ground and accepts the resultant shock, rotates through several actions, and eventually pushes off with the assistance of the foot and leg muscles. If the person's foot is imbalanced or unstable, the connective tissues and bones can be strained or even broken. Moreover, any imperfections in a person's foot, or the support of that foot, can drastically decrease the efficiency of body movement.

In the past a variety of devices and supports have been designed to correct various pathological conditions in a person's foot. Among these corrective appliances, including arch supports for correcting flat feet, are (1) a platform to relieve strain and permit toe gripping (Davis U.S. Pat. No. 2,415,580); (2) a metatarsal edge or longitudinal arch support (Davis U.S. Pat. No. 4,224,750); (3) a support designed to force bending of the big toe during walking by flexing at the hallux joint (Sigle U.S. Pat. No. 4,240,214); (4) a support designed to shift or roll the foot in the direction of the big toe by lowering the ball of the big toe in relation to the ball of the little toe (Sigle U.S. Pat. No. 4,317,298); (5) a support to provide an extension under the first phalanx (Morton U.S. Pat. Nos. 1,847,973 and 2,623,307); (6) an elongated pad positioned under the medial third of the calcaneous bone and the first metatarsal bone to tilt the rear part of the foot and the front part of the foot (Bunsick U.S. Pat. No. 4,170,233); and (7) a foot support contoured to the sole that terminates at its distal edge near the joints of the five metatarsal bones to the proximal phalanges, but distally of at least some of the joints (Delport U.S. Pat. No. 4,224,750).

To applicant's knowledge, these various prior art devices have failed to provide a support that corrects and stabilizes the foot in a broad category of applications. Nor have they produced a support that can broadly protect runners from serious strains and injuries caused, at least in part, by the natural imperfections of the human foot.

SUMMARY OF THE INVENTION

The present invention overcomes the problems and disadvantages of the prior art by providing a foot support that can be used in walking, running, skiing, and other normal activities and sports. The support compensates for the imbalances at the first and fifth phalanges of a foot and corrects for the inversion of the normal heel.

One object of the present invention is to provide a support that can be added as an insert to or can be incorporated into walking, running, and other shoes.

Another object is to provide a support which fosters increased efficiency and safety in walking and running.

Still another object is to provide a support that can promote proper foot rotation, provide a forward thrust from the heel to the toes, and stabilize the first and fifth rays during pronation and flexing.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises a foot support for a wearer's foot comprising a heel post means extending only under the heel bone of the foot and providing added elevation on the most lateral aspect of the heel bone relative to the most medial aspect of the heel bone for compensating for the natural inversion of the heel and preventing over pronation of the heel during walking and running; a fifth ray means extending only under the fifth proximal phalanx of the foot for compensating for lateral imbalance of the foot by establishing an effective amount of inward rotation of the foot for efficient forward thrust and preventing outward rotation of the foot and maximizing effective foot and body motion; and first ray means extending only under the first proximal phalanx of the foot for stabilizing the first toe and controlling the hypermobility of the first toe.

The invention further comprises a forward recovery foot support for a wearer's foot comprising a base means conforming generally to the contour of a human foot; first ray means attached to said base means and extending substantially only under the first proximal phalanx of the foot for stabilizing the first metatarsal and controlling the hypermobility of the first ray; and fifth ray means attached to said base means and extending substantially only under the fifth proximal phalanx of the foot for compensating for lateral imbalance of said foot by establishing an effective amount of inward rotation of the foot for efficient forward thrust and preventing outward rotation of the foot and maximizing effective foot and body motion.

In addition, the invention comprises a rearward recovery foot support for a wearer's foot comprising a base means conforming generally to the contour of the human foot and a heel post means extending only under the heel bone of the foot and providing added elevation on the most lateral aspect of the heel post for compensating for the natural inversion of the foot and preventing over pronation of the heel during walking and running.

As set forth more fully in the specification and drawings, the support of the present invention can be made from a variety of materials and can be made in the form of a shoe insert, or can be incorporated into a shoe.

The accompanying drawings, which are incorporated in and constitute a part of this specification, illustrate an embodiment of the invention and together with the description serve to explain the principles of the invention.

DESCRIPTION OF THE PREFERRED EMBODIMENT

Figure 1:
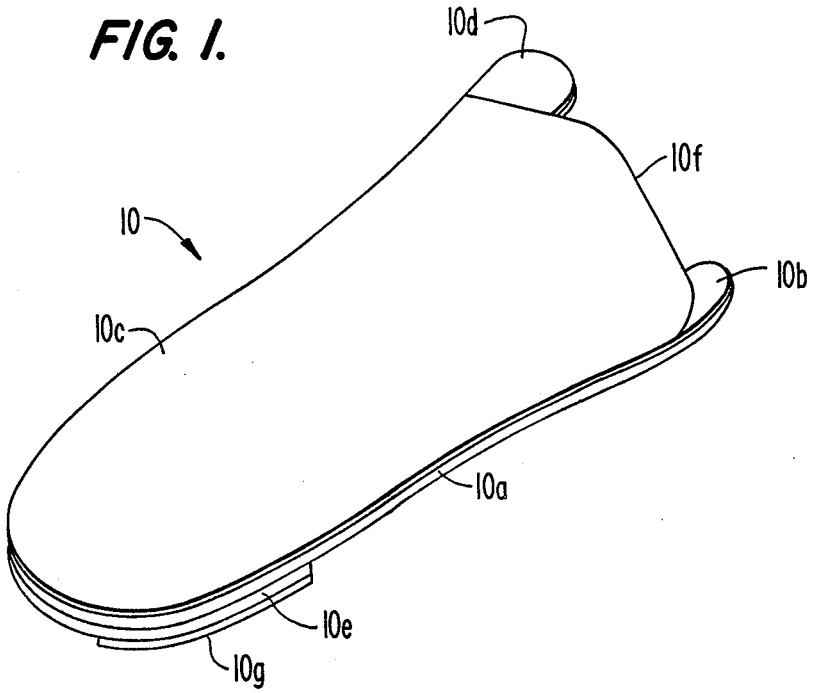
FIG. 1 is a perspective view showing a foot support made according to the present invention.

Reference will now be made in detail to the present preferred embodiments of the invention, examples of which are illustrated in the accompanying drawings. Wherever possible, the same or like reference numbers will be used throughout the drawings to refer to the same or like parts.

In order to fully explain and describe the present invention, it is first necessary to explain the principles of walking and running, along with the problems associated with the foot. When we walk and run, we exert forces in one direction in order to propel ourselves in the opposite direction. So, for every action, there is an equal and opposite reaction. In order for one to apply force to the running and walking surface and get back the reciprocal forces necessary for locomotion, we need to apply and receive those forces through two very critical levers—our feet.

The framework of the foot is composed of the combination of bone segments bound together by ligaments. The foot provides the means for sustaining weight and kinetic forces and transmitting them from the ankle to the points of contact of the foot with the ground. In a normal stride, the heel of the foot first contacts the ground and sustains the person's weight and the kinetic impact force. As the stride continues, weight and kinetic stresses are applied to the midfoot, the forefoot and the toes.

The proper way to gain biomechanical balance both in stride length and stride rate is to increase flexibility and elasticity, thereby improving the ability of our limbs and levers to move easily through a full range of motion. Any increase in flexibility automatically increases the ease with which we can move a limb. Increased ease of movement allows us to move farther on each stride (stride length). In addition, because the effort to move the leg is less, the same effort makes the leg go faster (stride rate). Therefore, a foot support preferably should increase the elasticity of the muscles, tendons, ligaments and muscle sheathing involved in walking and running. To be effective, a foot support must at least reduce the strain placed on these connecting tissues and promote body movements and motions that promote the most effective and least stressful transfer of forces through these tissues. For proper foot function, a foot support also should maintain balance and stability throughout the stride When a person walks or runs, his foot progresses through a series of phases. These phases are generally described as the heel strike phase (when the heel first strikes the ground), the contact phase (when the heel contacts the ground and rotates), the midstance phase (when forces are transferred through the midfoot to the forefoot), the propulsion phase (when the toes and foot push off and propel the body forward), and the toe off phase (just before the foot leaves the ground) Applicant has discovered that the shape, size, characteristics and support of a person's heel, little toe, and big toe can significantly effect the efficiency and safety of walking and running.

In the average person, the heel of the foot is inverted 2°-3° (tilted outwardly because it is lower on the outside (lateral side) than on the inside (medial side). This characteristic may cause abnormal pronation (inward rotation) during the gait cycle. When the heel first strikes the ground, the heel is inverted this initial 2°-3°. After the heel contacts the ground, the foot begins to pronate (rotate inwardly). Typically, the total degree of pronation during a gait is 4°-6°. Obviously, if the heel at contact is inverted 2°-3° and pronates through the neutral axis to 4°-6° of pronation, the foot and its members will be subject to a total of 6°-9° of rotation. This degree of rotation places considerable stress on the foot and its connective tissue and can have adverse effects on the other phases of the gait.

In the majority of individuals, the first metatarsal (big toe) of a human foot is shorter than the second metatarsal. This creates an imbalance in locomotion. The 5th (small toe) metatarsal is the shortest and the most unstable of the five metatarsals in the human foot. The first metatarsal and fifth metatarsal have independent motions available to them in dorsiflexion and plantarflexion (up and down motion) and also have some lateral movement available to them. As a result, the first and fifth metatarsals and toes are unstable.

The three central toes of the foot are considerably more stable than the outer toes. On passive examination of the foot, the three central rays (2nd, 3rd, & 4th metatarsals) individually exhibit only plantarflexion (downward) motion from the transverse plane in which they are locked during the midstance period of gait. In fact, none of the rays can be dorsiflexed (upward) above the loaded common transverse plane position of the metatarsal heads when the midtarsal joint (mid foot) is fully pronated during the midstance period.

From a biomechanical standpoint, the function of the foot during walking or running can be described generally as follows. At the contact phase when the foot first hits the ground, the normal weight distribution first is applied to the lateral (outside) side of the heel. The heel then pronates or rolls medially to shift the weight distribution toward the inside of the heel. The heel also rolls laterally or forwardly so that the weight moves forward along the lateral weight bearing surface of the bottom of the foot to the fifth metatarsal head. The forefoot then pronates or rolls inwardly so that tee weight shifts across the fourth, third and second metatarsal bones toward the first metatarsal bone. Then, the weight moves forward through the first toe with the remaining toes aiding in the lift off.

When walking or running, the natural rolling motion of the foot is initiated when the heel bone makes contact with the ground. For the best transfer of forces, the foot should then roll in a manner such that the rolling motion is directed forwardly so that the toes, particularly the big toe, roll straight ahead. Applicant has discovered that the natural inversion of most heels at a 2°–3° angle deters proper heel pronation and forward transfer.

As weight is transferred to the forefoot, the ball of the foot at the little toe touches the ground first. Then, the foot rolls forward shifting weight forward onto the toes which bend and unbend as the person's body moves forward over and beyond the toes. This bending and unbending of the toes produces a springy forward functional thrust to the forward motion of the running body. As the person's weight moves forward from the ball of the foot onto the toes, the foot rotates slightly inward (pronates) due to the staggered arrangement of the toes and the contour of the ball of the foot. This inward rotation is a natural part of the foot movement which enables each toe in succession, beginning with the little toe, to contribute its own component of springy forward thrust. However, if the foot is laterally imbalanced, or if the metatarsal bone which precedes the little toe is unnaturally short, there will be insufficient inward rotation for the most efficient forward thrust, or worse, there will be outward rotation which tends to throw the body off balance, impeding efficient motion or perhaps even causing a sprain or a pulled muscle.

During a normal gait with its contact, midstance, propulsion and toe lift phases, there is a continual shifting of forces and torque. The torque on the foot peaks at the end of the midstance phase, and the supination and pronation forces on the foot are greater after the midstance phase. Thus the maximum torque force and supination and pronation forces are applied to forefoot area during the propulsion phase.

A runner with the greatest continuity of motion will be one with a normal foot that produces linear shear forces against the foot during contact and again during propulsion. Lateral sheer forces—side to side—are generally not as significant during normal walking locomotion. However, in running and jogging they may have a greater effect. Moreover, these lateral forces may be accentuated by any of several pathological conditions which exaggerate lateral motion such as lateral imbalance.

Figure 2:
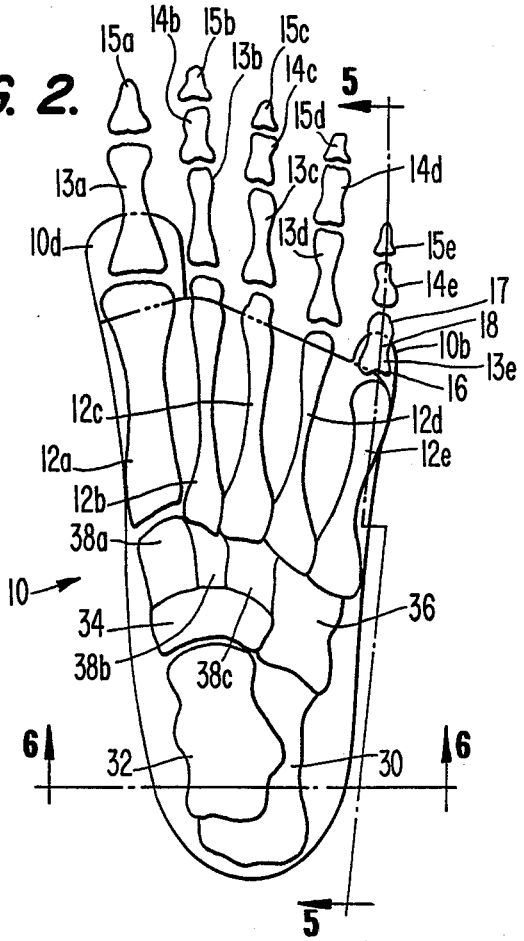
FIG. 2 is a top plan view of the skeleton structure of a right foot showing the relative size, shape and position of the foot support embodying the invention.
Figure 5:
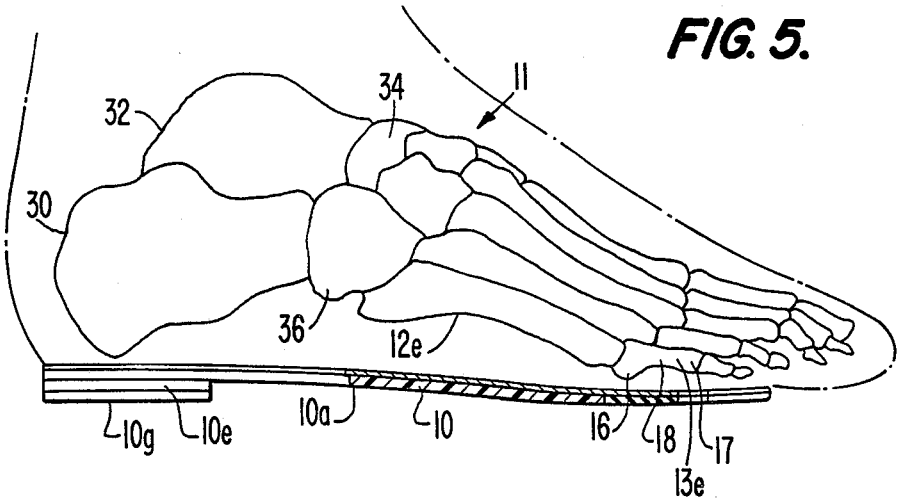
FIG. 5 is a longitudinal vertical section taken along line 5—5 of FIG. 2.
Figure 6:
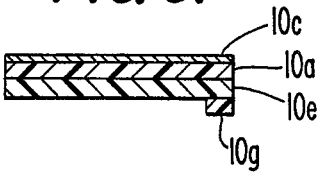
FIG. 6 is a vertical section taken along line 6—6 of FIG. 2.

Applicant has designed the support of the present invention to overcome the problems associated with the over inversion of the heel and the instability of the first and fifth toes. The support is shown generally in the perspective drawing at FIG. 1. The support 10 includes a base 10*a*, a fifth ray extension 10*b*a cover 10*c*, a first ray extension 10*d*, and a two-part heel post comprising post member 10*e* and lateral shim 10*g*. To better illustrate the principles of the present invention and the positions of the elements of the present invention, the bone structure of a person's right foot 11 and the foot support 10 therefor are shown in FIGS. 2 and 5. Left foot positions and contours would be reversed.

The bottom surface of the rear portion of a foot includes a heel bone 30, known as the calcaneus, which is connected to the forefoot through a series of bones shown generally as navicular 34, cubiod 36, cunieforms 38*a*, 38*b*, and 38*c*. The heel bone extends from the rear of the foot to its proximal end where it is connected to talus 32. As a person walks or runs, the heel bone swings relative to the navicular, cuboid, cunieforms (midtarsal joints) and metatarsals as the foot rolls forward Foot 11 has five metatarsal bones 12, shown as 12*a* for the first metatarsal on the inside foot, followed by the second 12*b*, third 12*c*, fourth 12*d*, and fifth 12*e* metatarsals. The principal bones of the toes are the proximal phalanges 13*a* to 13*e* which extend forward in line from the respective metatarsal bones 12*a* to 12*e* to which they are joined by flexible joints at the toe bases. The other toe bones are the middle phalanges 14*b* to 14*e* and the distal phalanges 15*a* to 15*e*, the large toe having no middle phalanx.

Each proximal phalanx, as shown generally in FIG. 5. with reference only to the fifth phalanx, is composed of a base 16 at the proximal end, a head 17 at the distal end and a neck 18, which is that elongated portion between the head and base where a section would have less area than the greatest sectional area of the head or base The forward edge 10*f* of the foot support 10 extends across under the foot along a line generally at the forward ends of the metatarsal bones 12*a* through 12*e*. That line extends approximately through the joints between the metatarsal bones and the proximal phalanx bones 13*a* through 13*e*, as indicated in FIG. 2. This line should be near the joints and may extend proximally from the joints up to a centimeter. Preferably, the line extends proximally about 5 millimeters just behind the joints.

The support portion or base 10*a* can be made from a variety of materials. The base preferably is substantially rigid or stiff and made of any suitable material such as fiberglass, reinforced plastic or resin impregnated with graphite. As shown in FIG. 1, the base conforms generally to the contour of the sole of the foot and extends from the heel to approximately the distal end of the metatarsals. At the rear of the base is a heel seat which is shaped to conform to and cradle the wearer's heel.

Figure 4:
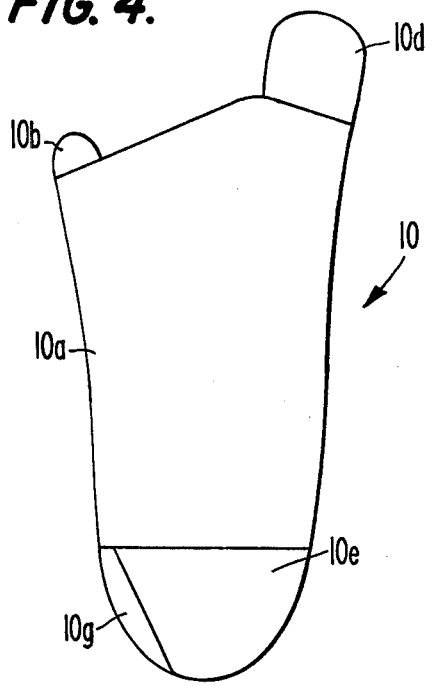
FIG. 4 is a bottom plan view of the support shown in FIG. 1.

A heel post 10*e* and 10*g* is included or attached to the underside of the base 10. The heel post is made of a resilient material, such as a hard rubber, and is attached to the base by glue or similar means. The heel post preferably should have shock absorbing qualities. The heel post shown in the figures extends from the medial (inside) edge of the base to the lateral (outside) edge. The heel post extends longitudinally from the posterior of the heel bone 30 to the anterior portion of that bone. That heel post includes post member 10*e* and a longitudinal shim 10*g*, best shown in FIG. 4. If used with a shoe or insert, the heel post can begin at the rear end of the insert or shoe, but it should not extend beyond the front of the heel bone 30. The heel post, therefore, is significantly shorter in length than a typical heel of a shoe. The shim 10*g* is located under the most lateral aspect of the heel post and extends from the rear of the heel post to the forward end of the heel post. This shim provides added elevation on the most lateral aspect of the heel post to compensate for the 2°–3° inversion which is present in most persons' heels prior to the heel strike. This elevation increases balance and stability and promotes proper foot pronation and flexing. It also decreases the stress on the wearer's foot and promotes proper forward propulsion toward the first ray.

Although the particular embodiment illustrated in the drawings shows a heel post composed of both the post member 10*e* and shim 10*g*, other structural forms can provide the benefit of applicant's invention. For example, the heel post can be formed in the shape of a wedge having an increased thickness at the lateral side of the wedge, relative to the medial side. In addition, when the heel post is added to the base of an insert or orthotic, one or more longitidunal shims can be added to the underside of the base. For example, if a single shim were added, the shim would be located directly to the most lateral aspect of the base, in essentially the same manner as the shim 10g is fixed to post member 10e. If more than one longitudinal shim were utilized, the shim on the most lateral aspect of the heel would be thicker than the respective additional shims positioned more toward the medial side of the heel.

The applicant has discovered that a heel post which provides an added thickness of approximately one sixteenth (1/16) of an inch to the lateral side of the heel (relative to the medial side) corrects for approximately a 1° inversion of the heel in its normal contact position. As previously explained, the heels of most persons are normally inverted by 2°-3°. Applicant has discovered that a heel post providing a correction in the range of 1°-3° provides the desired benefits without adversely stressing the foot. A heel post providing an offset of 1° (1/16 inch elevation) compensates for the natural inversion of most persons' heels and decreases the degree of torsion and stress applied to the heel and ankle area during heel pronation A post providing at least a 1° correction therefore is the present preferred embodiment.

The heel post preferably is made of resilient material and extends across the entire width of the heel portion of the base. This preferred heel post can have varying thickness to elevate the entire heel, as desired to make height adjustments to correct for imbalances in a particular person's heel. However, in each such embodiment the heel post would not extend beyond the anterior portion of the heel bone and would provide increased elevation to the most lateral aspect of the heel bone, relative to the most medial aspect of the heel bone.

Figure 3:
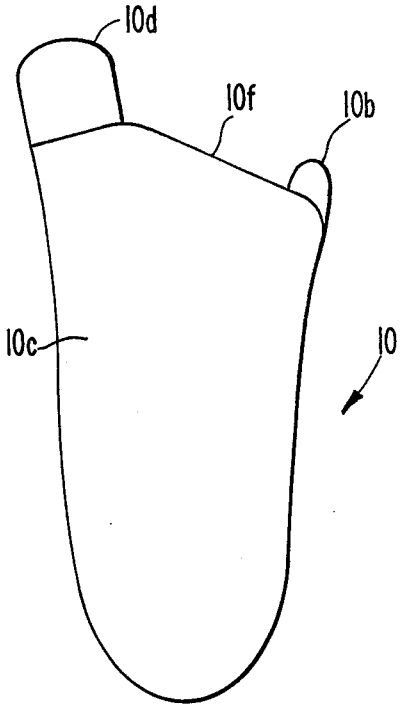
FIG. 3 is a top plan view of the support shown in FIG. 1.

The first ray extension 10d and the fifth ray extension 10b extend from the front edge of the base 10 and are aligned with the first and fifth phalanges, respectively. In the embodiment illustrated in FIGS. 3 and 4, the extensions are attached by glue to leather cover 10c .. which in turn is glued to the base 10a. The base, heel post, leather cover, and ray extensions therefore combine to form a unitary support In the embodiment shown, the toe extensions 10b and 10d are more flexible and resilient than foot support 10a which is made from a stiff material. The toe extensions may be made of a variety of flexible materials, such as rubber. While they preferably should have some resiliency, they should also have sufficient strength and resistance to deformation to support the toes and place a resistance force against the toes as they bend.

The first ray extension shown in FIGS. 1-5 is an extension 10d of foot support base 10. The extension terminates distally short of the distal end of the first proximal phalanx and preferably terminates distally beneath the first proximal phalanx neck. The proximal end of the extension 10d shown in the figures terminates at its junction with body portion 10 of the foot support. The proximal end of an extension 10d preferably terminates near, slightly proximal to, or up to 5 to 10 millimeters proximal to the metatarsal phalanx joint However, the first ray extension can project rearwardly beyond that position and still provide significant benefits. It should not, however, extend distally beyond the distal end of the first proximal phalanx. Therefore, the first ray extension extends only under the first proximal phlanx. The first ray extension has a width equal to or slightly larger than the thickness of the first phalanx. It does not extend under the second phalanx.

The fifth ray extension 10b shown in FIGS. 1-5 is an extension of foot support base 10. The extension terminates distally short of the distal end of the fifth proximal phalanx and preferably terminates distally beneath the fifth proximal phalanx neck. The proximal end of the extension terminates at its junction with the body portion 10a of the foot support. The proximal end of extension 10b terminates near, slightly proximal to, or up to 5 to 10 millimeters proximal to the metatarsal phalanx joint It may, however, project rearwardly beyond that point and provide significant benefits. It should not, however, extend distally beyond the distal end of the first proximal phalanx The fifth ray extension has a width that is equal to or slightly larger than the thickness of the fifth phalanx. It does not extend under the fourth phalanx.

As will become apparent, each of the heel post 10e and 10g, the first ray extension 10d, and the fifth ray extension 10b individually provide significant improvements in the support, stabilization and protection of the foot and leg. The fifth ray extension alone is the subject of an earlier application of applicant which is allowed application Ser. No. 698,575 filed on Feb. 6, 1985. Through continued experimentation and study, applicant has discovered that the heel post and the first ray extension of the present invention provide the additional benefits described herein Moreover, applicant has discovered that these three elements in combination cooperate to provide a support that promotes optimum rearfoot and forefoot recovery The heel post of the present invention increases the surface contact of the support and provides both stability and shock absorption. The heel is well padded and solid in bone and tissue structure. Applicant has discovered that because of this strength, the heel can accept forces that are sufficient in degree to prevent undesirable pronation and promote correct forward force transfer, without causing trauma or injury to the heel. Therefore, corrective forces applied through the heel post do not create undue stress. Instead, the heel post applies the force of contact equally throughout the bottom of the heel.

The heel post also decreases the degree of pronation applied to the foot, since the range of rotation is decreased by several degrees. In addition, because the heel post ends at the distal end of the heel bone, it applies the corrective posting forces directly on that bone, rather than the bones adjacent the heel bone. The heel post also allows free relative movement between the heel bone and the other bones of the foot, because it ends at the joint. As the stride continues, the heel post tends to spread the weight and kinetic forces forwardly and more equally toward all the toes.

As the weight and kinetic load is applied from the heel through the midfoot and into the fifth ray, the fifth ray extension stabilizes the foot and promotes efficient pronation of the foot and transfer of forces. The fifth ray extension projects and extends forward push-off and thrusting, disperses shock, and retards lateral forces. It also acts as a stabilizer for all of the muscles that insert anatomically into the fifth proximal phalanx. The extension in combination with the heel post directs the foot action in a forward extended position to promote the most efficient and least stressful manner for producing motion.

The point in the foot which gives the greatest range of dorsiflexion is the oblique axis of the midtarsal joint or midfoot. The positioning of the fifth ray extension allows it to use the oblique axis vector forces as well as the muscle dynamics of the lumbricalis and interossei muscles which insert into the proximal phalanges-base and head areas. The fifth ray extension is most functional at the neck of the proximal phalanx where the muscle action has greatest motion as a movement arm of a muscle-tendon apparatus. The relatively short movement arm of the fifth ray extension provides better motion than a long movement arm, which may create a rolling motion.

The fifth ray extension preferably is made of material that does not fully collapse under the body's weight in propulsion so that the small toe can curve over the extension during midstance and propulsion so the extension can act as a lever. The extension provides a stabilization system that directs the foot action forward simultaneously with all lesser digits in a stable forward recovery extended position for the most efficient and least stressful manner for producing motion. The extension is flat but the thickness may, but need not necessarily, be made such as to compensate for functional lateral imbalance as measured across the foot at the distal portion of the metatarsals or the midportions of the phalanges. The extension **10*b*** having some thickness does compensate in any event for lateral imbalance at the midportions of the phalanges. The extension should be flat and as wide or somewhat wider than the fifth phalanx but should not reach the fourth phalanx.

Preferably, the remainder of the foot proximal to the proximal phalanges is also supported by the base member **10*a*** that is contiguous and/or integral with the fifth ray extension. This foot support preferably should be composed of a semi-rigid material, thereby permitting a pivotal movement of the extension relative to the support.

The anatomical position of the 5th ray extension is such that it extends to the middle of the proximal phalanx for dynamic balance and pathomechanically for better function control and stability in forward motion This position is optimum because the lumbricalis and the interossei muscles attach to the phalanges at approximately this position.

The lumbricalis muscles during locomotion (1) extend the phalanges joints of the four lesser toes during the midstance and propulsion periods, (2) assist in stabilizing the proxinal phalanx of the lesser toes in a plantarflexion direction against ground reaction forces during propulsion, and (3) provide slight adduction stability of the proximal phalanx of the lesser digits which resists the abduction force of ground reaction during propulsion. The tendons attach these muscles by a small slip to the medio-dorsal aspect (middle-top) of the area of the head of the proximal phalanx Without the participation of the lumbricalis muscles, the forefoot does not have the capability of extending the phalanges of the lesser digits forward The interossei muscles also help the forefoot to function during locomotion. They (1) stabilize the bones of the proximal phalanges of the four lesser toes against their metatarsal heads and (2) stabilize the bases of the proximal phalanges transversely. They provide adductor-abductor stabilizing factors to the toes at the metatarsal-phalanged joint. There are seven interossei muscles: four are dorsal and three are called plantar interossei. These interossei insert into the medial and lateral sides of the base of the proximal phalanges. They have longer lever arms from the vertical axis than from the transverse axis. Therefore, they exert a strong adduction-abduction force upon the proximal phalanges.

The fifth ray extension ends just posterior to the head of the proximal phalanx of the fifth toe, where there is a dynamic center-of-pressure due to these strong muscle inserts. The 5th ray extension therefore tends to create a trampoline or spring lever effect where the pressure is greatest. The fifth ray extension has a stabilizing and cushioned effect on the muscles and acts as a spring lever in forward propulsion. In addition, the fifth ray creates a stabilizing extension on the outside of the foot that prevents undesirable outward rotation of the foot while at the same time promoting an effective and controlled amount of inward rotation for efficient forward thrust. As a result, the fifth ray maximizes effective foot and body motion and minimizes strain and trauma.

The use of the heel post in combination with the fifth ray is particularly effective, since the heel post directs the forces more equally over the toes and initiates proper pronation. Therefore, the fifth ray can redirect the forces and promote proper pronation without placing any injurious forces or strains on the smaller structure and tissues of the small toe.

As the vector forces from the heel and the muscles are placed into motion from the fifth ray extension, it is important to enhance as much balance and stability from the first ray which again also has independent motion. The anatomical position of the first ray extension is such that it extends to the middle of the proximal phalanx of the great toe or hallux, for dynamic balance and stability of the foot. This balance and stability is important, since the first ray is where the last part of weight is dispersed in a projectory forward force, and the muscles of the foot extend a substantial propelling force on the first ray. The first ray extension acts as a stabilizer for the muscles that insert into the first ray.

The normal locomotion of the first ray requires 65–75 degrees of first metatarsal phalangeal joint dorsiflexion during propulsion. A smooth, gliding articulation between the base of the proximal phalanx, first metatarsal head and sesamoids (2 small bones under 1st metatarsal head) is necessary. As the foot enters the propulsion phase of gait, the great toe or hallux must be stabilized against the ground so that it can bear the weight transmitted through the first metatarsal.

As the heel lifts off the ground during the propulsion phase, the reaction of the ground forces dorsiflexion of the stabilized hallux. Hallux stability and first metatarso-phalangeal joint function require a stabilized, plantarflexed first ray, as well as normal sesamoid function, and proper strength and alignment of the muscles. The flexor hallucis brevis inserts into the tibial [outside] and fibular [inside] sesamoid bone and continues forward and inserts into the base of the proximal phalanx plantarly. The flexor hallux longus inserts into the base of the terminal phalanx. The abductor hallucis-attaches to the sesamoid apparatus medially and then to the medial plantar portion of proximal phalanx. The adductor hallucis arises from the medial side of the shafts and bases of the second, third, and fourth metatarsals. It courses forward and medially. The transverse head arises from the capsule tissue covers the metatarsal heads and the plantar ligaments of the third, fourth, and fifth metatarsophalangeal joints and from the deep, transverse metatarsal ligament. It courses medially. The two heads meet in the first intermetatarsal space and insert primarily onto the sesamoid apparatus as a cojoined tendon. From the sesamoid, it continues forward to the medial and plantar portion of the base of the proximal phalanx These muscles all act to stabilize the hallux or great toe against the ground.

Plantarflexion of the first ray to the ground is effected by the pull of the peroneus longus (muscle from the lateral or outside of the leg which courses down under the lateral aspect of the ankle down under and across the foot to the medial or inside as it inserts into the base of the first ray) about a rigid lateral column and lesser tarsus. The fifth ray extension helps to stabilize this muscle if it becomes contracted or tight.

As ground reaction forces dorsiflex the hallux and the first ray plantarflexes, the distal aspect of the first metatarsal head articulates more and more with the sesamoids. The sesamoids function as pulleys for the muscles that stabilize the hallux. As the distal surface of the metatrsal head contacts the sesamoids, the base of the stabilized (not moving) phalanx glides along the dorsal articular surface of the metatarsal head. The actual transverse axis (instant center of motion) of sagittal plane first metatarsophalangeal motion migrates dorsally and proximally. Only at end range dorsiflexion does the base of the phalanx begin to compress into the dorsal aspect of the articular surface of the metatarsal head. Without the normal plantarflexion of the first ray during propulsion, only 25–30 degrees of metatarsophalangeal joint dorsiflexion could occur before the phalangeal base would begin to compress into the metatarsal head. The first ray extension helps to stabilize the ground reactive force as well as the muscles.

The first ray extension also compensates for the problems caused by a shorter first metatarsal. When the first metatarsal fails to supports its share of support, the unsupported force is transposed to the second metatarsal, and to a lessor degree, the third metatarsal. This can cause trauma and injury. For example, when the heel of the foot is lifted, weight is thrown upon the toes of the supporting foot. If the second metatarsal is longer than the first (the normal condition), the major share of the bodyweight becomes increasingly concentrated upon the second metatarsal. This abnormal distribution of weight and kinetic force upon the weaker second metatarsal imposes undesirable stresses upon the bones and tissues of the foot. These strains can result in damage to or breaking of the bones, injury to muscles and ligaments, and early fatigue, aches and spasms in the feet and the legs.

The first ray extension overcomes this problem by effectively extending the first metatarsal and thereby providing a supporting surface for the forces which extend down the first phalanx. The first ray extension also stabilizes the first ray itself, thereby minimizing the hypermobility of the first ray. In addition, the first ray extension prevents undesirable over pronation of the foot and instead promotes forward rolling of the first phalanx. Since the first ray extension ends at approximately the midportion of the first proximal phalanx, the big toe during propulsion flexes over the end of the first extension, providing an increased lever effect.

The fifth ray extension **10*b* and the first ray extension 10*d* may be attached to the support 10*a* at the edge 10*f* or extend slightly under the body thereof to provide additional surface for adhesion. Any means of attaching the materials used in 10*b*, 10*d*, or 10*a*** may be used. The ray extensions may also be a part of a unitary layer of flexible resilient material applied over the entire sole.

While the fifth ray extension stabilizes the lateral aspect of the foot, with all the muscle functions being controlled and stabilized, the first ray extension provides an equal and opposite reaction on the medial side stabilizing and controlling motion. The first and fifth ray extensions in combination control, balance, and stabilize the foot, create a forward projectory force, and provide a unique forward recovery system. The heel post and first and fifth ray extensions combine to create a total support system which minimizes trauma and creates optimum movement and efficiency.

In the embodiment disclosed, the base, heel post, first ray extension, and fifth ray extension are each made from separate pieces and are then constructed as a unit. It should be apparent, however, that the support in the present invention can be formed of a single piece of material or can be molded as a single unit. The present invention, therefore, can readily be made as an insert for a shoe, or as an orthotic. The unitary structure could be made of a variety of rigid or resilient materials and would provide the wearer with the significant benefits described herein. Preferably, a unitary support would have some degree of resiliency so as to cushion shocks and permit some gripping. On the other hand, the material should not merely collapse under body weight, since the extensions should serve as lever arms against which the phalanges should press.

Figure 7:
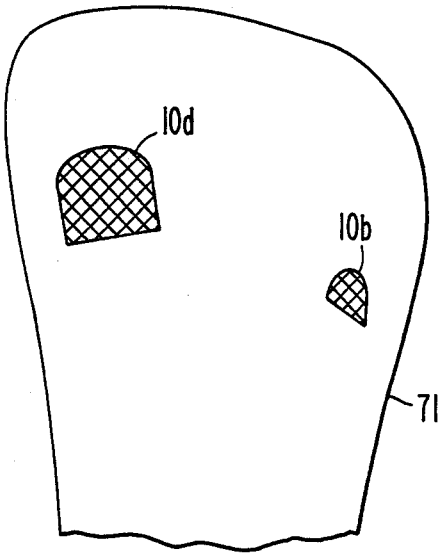
FIG. 7 is a top plan, partial view illustrating the first and fifth ray means incorporated into the sole of a shoe.
Figure 8:
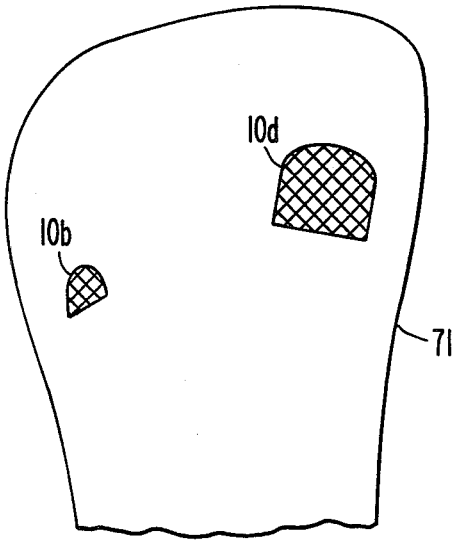
FIG. 8 is a bottom, partial view of the embodiment shown in FIG. 3.

It should also be apparent that all or certain elements of the present invention can be incorporated into a shoe design. The heel post of the present invention could be easily added to a shoe by elevating the heel either at the inside or the exterior of the shoe. The heel post is shorter in longitudinal length than a standard shoe heel. As shown in FIGS. 7 and 8, the first and fifth ray extensions can be incorporated into the sole 71 of a shoe, and these extensions preferably would be made of a more rigid material than the sole of the shoe. The extensions preferably would extend proximally only under the first and fifth proximal phalanges, respectively. They could, however, project rearwardly beyond the posterior of the phalanges and provide significant benefits. They should not extend distally beyond the distal ends of the proximal phalanges, and preferably would end at the neck of the respective proximal phalanges.

It will be apparent to those skilled in the art that various modifications and variations can be made in the foot support of the present invention and in the construction of this foot support without departing from the scope and spirit of the invention. Such embodiments of the invention will be apparent to the skilled in the art from consideration of the specification and practice of the invention disclosed herein. It is intended that the specification and examples be considered as exemplary only, with a true scope and spirit of the invention being indicated by the following claims.

What is claimed is:

1. A foot support for a wearer's foot comprising:

a heel post means extending only under the heel bone of the foot and providing added elevation on the most lateral aspect of the heel bone relative to the medial aspect of the heel bone for compensating for the natural inversion of the heel and preventing over pronation of the heel during walking and running; and first ray means extending only under the first proximal phalanx of the foot for stabilizing the first toe and controlling the hypermobility of the first toe, said first ray means extending to about the midportion of the first proximal phalanx of the foot.

2. A foot support for a wearer's foot comprising:

a heel post means extending only under the heel bone of the foot and providing added elevation to the most lateral aspect of the heel bone relative to the most medial aspect of the heel bone for compensating for the natural inversion of the heel and preventing over pronation of the heel during walking and running;

a fifth ray means extending only under the fifth phalanx of the foot for compensating for lateral imbalance of the foot by establishing an effective amount of inward rotation of the foot for efficient forward thrust and preventing outward rotation of the foot and maximizing effective foot and body motion; and first ray means extending only under the first proximal phalanx of the foot for stabilizing the first to and controlling the hypermobility of the first toe, said first ray means extending to about the midportion of the first proximal phalanx of the foot.

3. The foot support of claim 1 or 2 wherein said heel post includes a longitudinal shim extending beneath the most lateral aspect of the heel bone.

4. The foot support of claim 3 wherein said shim has a height between the range of 1/16 inch and ¼ inch.

5. A forward recovery foot support for a wearer's foot comprising:

base means conforming generally to the contour of a human foot;

first ray means attached to said base means and extending substantially only under the first proximal phalanx of the foot for stabilizing the first toe and controlling the hypermobility of the first toe, said first ray means extending to about the midportion of the first proximal phalanx of the foot; and fifth ray means attached to said base means and extending substantially only under the fifth proximal phalanx of the foot for compensating for lateral imbalance of said foot by establishing an effective amount of inward rotation of the foot for efficient forward thrust and preventing outward rotation of the foot and maximizing effective foot and body motion.

6. The foot support of claims 2 or 5 where the fifth ray means extends from said base means to about the midportion of the fifth proximal phalanx of the foot.

7. The foot support of claim 5 further comprising a heel post attached to said base means and extending substantially only under the heel bone of the foot and providing added elevation on the most lateral aspect of the heel bone relative to the medial aspect of the heel bone for compensating for the natural inversion of the heel and preventing over pronation of the heel during walking and running.

8. The foot support of claim 7 wherein said heel post is made of rubber.

9. A rearward recovery foot support for a wearer's foot comprising:

a base means conforming generally to the contour of the human foot; and a heel post means attached to said base means and extending only under the heel bone of the foot and providing added elevation on the most lateral aspect of the heel bone relative to the medial aspect of the heel bone for compensating for the natural inversion of the foot and preventing over pronation of the heel during walking and running, said heel post including a longitudinal shim extending beneath the most lateral aspect of the heel bone.

10. The foot support of claims 1, 2, or 4 wherein said heel post is a lift that extends longitudinally from the posterior end of the heel of the foot to the anterior end of the heel of the foot and extends laterally across at least the width of the foot.

11. The foot support of claim 10 wherein said lift has an increased relative height of between 1/16 and ¼ inch under the most lateral aspect to the lift relative to the most medial aspect of the lift.

12. The foot support of claim 11 wherein said lift has an increased relative height of approximately ¼ inch.

13. The foot support of claim 11 wherein said lift is made of a shock absorbing material.

14. The foot support of claim 9 wherein said heel post is attached to the bottom of said base.

15. A foot support for a wearer's foot comprising:

a heel post means extending only under the heel bone of the foot and providing added elevation on the most lateral aspect of the heel bone relative to the most medial aspect of the heel bone for compensating for the natural inversion of the heel and preventing over pronation of the heel during walking and running;

a fifth ray means extending only under the fifth phalanx of the foot for compensating for lateral imbalance of the foot by establishing an effective amount of inward rotation of the foot for effective forward thrust and preventing outward rotation of the foot and maximizing effective foot and body motion, said fifth ray means extending to about the mid portion of the fifth proximal phalanx of the foot; and first ray means extending only under the first proximal phalanx of the foot for stabilizing the first toe and controlling the hypermobility of the first toe.

16. A forward recovery foot support for a wearer's foot comprising:

a base means conforming generally to the contour of a human foot;

first ray means attached to said base means and extending substantially only under the first proximal phalanx of the foot for stabilizing the first toe and controlling the hypermobility of the first toe; and fifth ray means attached to said base means and extending substantially only under the fifth proximal phalanx of the foot for compensation for lateral imbalance of said foot by establishing an effective amount of inward rotation of the foot for effective forward thrust and preventing outward rotation of the foot and maximizing effective foot and body motion, said fifth ray means extending from said base means to about the midportion of the fifth proximal phalanx of the foot.

17. The foot support of claims 15 or 16 wherein said first ray means extends to about the midportion of the first proximal phalanx of the foot.

18. A forward foot support for a wearer's foot comprising:

a substantially stiff base means conforming generally to the contour of a human foot;

first ray means attached to said base means and extending substantially only under the first proximal phalanx of the foot for stabilizing the first toe and controlling the hypermobility of the first toe; and fifth ray means attached to said base means and extending substantially only under the fifth proximal phalanx of the foot for compensating for lateral imbalance of said foot by establishing an effective amount of inward rotation of the foot for efficient forward thrust and preventing outward rotation of the foot and maximizing effective foot and body motion;

said first and fifth ray means being resilient for maximizing the effective forward thrust provided by the binding nd unbinding of the toes of the foot during running.

19. The foot support of claim 18 wherein the front edge of said base is located back from the heads of the second, third and fourth metatarsal bones.

20. A forward recovery foot for a wearer's foot comprising:

a base means conforming generally to the contour of a human foot, the front edge of said base being located back from the heads of the second, third and fourth metatarsal bones;

first ray means attached to said base means and extending substantially only under the first proximal phalanx of the foot for stabilizing the first toe and controlling the hypermobility of the first toe; and fifth ray means attached to said base means and extending substantially only under the fifth proximal phalanx of the foot for compensating for lateral imbalance of said foot by establishing an effective amount of inward rotation of the foot for efficient forward thrust and preventing outward rotation of the foot and maximizing effective foot and body motion.

21. The foot support of claim 20 wherein said base means is substantially stiff.

22. The foot support of claim 21 wherein said first and fifth ray means are resilient for maximizing the effective forward thrust provided by the binding and unbinding of the toes of the foot during running.

23. The foot support of claim 22 wherein said foot support is a shoe insert for a shoe.

24. The foot support of claim 19 or 20 wherein said first ray means extends to about the midportion of the first proximal phalanx of the foot and has a width which is approximately the width of the first phalanx and the fifth ray means extends to about the midportion of the fifth proximal phalanx of the foot and has a width which is approximately the width of the fifth phalanx.

25. The foot support of claim 24 wherein the first ray means is a separate element that extends forward from the front edge of said base and said fifth ray means is a separate element that extends forward from the front edge of said base.

26. The foot support of claim 5, 18, or 20, wherein said base is the sole of a shoe and said first and fifth ray means are incorporated directly into the sole of the shoe.

27. The foot support of claim 15 wherein the first and fifth ray means are made of a material which is stiffer than the portion of the shoe sole into which they are incorporated.

28. The foot support of claim 3, 29 wherein the base and the first and fifth ray means are made from the same material.

29. The foot support of claim 17 wherein the base, first ray means and fifth ray means form a single, integral unit.

30. The foot support of claim 18 wherein said foot support is a shoe insert.

31. A foot support for a wearer's foot comprising:

a heel post means extending only under the heel bone of the foot and providing added elevation on the most lateral aspect of the heel bone relative to the medial aspect of the heel bone for compensating for the natural inversion of the heel and preventing over pronation of the heel during walking and running, said heel post including a longitudinal shim extending beneath the most lateral aspect of the heel bone; and first ray means extending only under the first proximal phalanx of the foot for stabilizing the first toe and controlling the hypermobility of the first toe.

32. A foot support for a wearer's foot comprising:

a heel post means extending only under the heel bone of the foot and providing added elevation on the most lateral aspect of the heel bone relative to the most medial aspect of the heel bone for compensating for the natural inversion of the heel and preventing over pronation of the heel during walking and running, said heel post including a longitudinal shim extending beneath the most lateral aspect of the heel bone;

a fifth ray means extending only under the fifth phalanx of the foot for compensating for lateral imbalance of the foot by establishing an effective amount of inward rotation of the foot for efficient forward thrust and preventing outward rotation of the foot and maximizing effective foot and body motion; and first ray means extending only under the first proximal phalanx of the foot for stabilizing the first toe and controlling the hypermobility of the first toe.

* * * * *

UNITED STATES PATENT AND TRADEMARK OFFICE

CERTIFICATE OF CORRECTION

PATENT NO. : 4,813,159

DATED : March 21, 1989

INVENTOR(S) : Robert F. Weiss

It is certified that error appears in the above-identified patent and that said Letters Patent is hereby corrected as shown below:

Claim 2, col. 13, line 22, change "to" to "toe".

Claim 16, col. 14, line 52, change "compensation" to "compensating".

Claim 20, col. 15, line 13, change "nd" to "and".

Signed and Sealed this

Twenty-second Day of August, 1989

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,813,159

DATED : March 21, 1989

INVENTOR(S) : Robert F. Weiss

It is certified that error appears in the above-identified patent and that said Letters Patent is hereby corrected as shown below:

Column 15, line 18, Claim 20, after "recovery foot" insert --support--.

Signed and Sealed this

Seventeenth Day of October, 1989

*Attest:*

DONALD J. QUIGG

*Attesting Officer*

*Commissioner of Patents and Trademarks*